US005850123A

United States Patent [19]

Potter

[11] Patent Number: 5,850,123

[45] Date of Patent: Dec. 15, 1998

[54] DUAL CARRIER DISPLAY DEVICE

[75] Inventor: Michael D. Potter, Grand Isle, Vt.

[73] Assignee: Advanced Vision Technologies, Inc, Rochester, N.Y.

[21] Appl. No.: 899,573

[22] Filed: Jul. 24, 1997

Related U.S. Application Data

[62] Division of Ser. No. 550,391, Oct. 30, 1995.

[51] Int. Cl.[6] ..... H01J 1/62; H01J 63/04

[52] U.S. Cl. ..... 313/512; 313/500; 313/503; 313/512; 445/24; 445/51

[58] Field of Search ..... 313/512, 503, 313/506, 500; 445/24, 51

[56] References Cited

U.S. PATENT DOCUMENTS

| | | | |
|---|---|---|---|
| 4,482,841 | 11/1984 | Tiku et al. | 313/503 |
| 4,751,427 | 6/1988 | Barrow et al. | 313/503 |
| 4,857,161 | 8/1989 | Borel et al. | 204/192.26 |
| 4,857,799 | 8/1989 | Spindt et al. | 313/495 |
| 4,897,319 | 1/1990 | Sun | 428/690 |
| 4,908,539 | 3/1990 | Meyer | 315/169.3 |
| 4,923,421 | 5/1990 | Brodie et al. | 445/24 |
| 4,940,916 | 7/1990 | Borel et al. | 313/306 |
| 5,063,327 | 11/1991 | Brodie et al. | 313/482 |
| 5,144,191 | 9/1992 | Jones et al. | 313/308 |
| 5,214,347 | 5/1993 | Gray | 313/355 |
| 5,233,263 | 8/1993 | Cronin et al. | 313/309 |
| 5,266,155 | 11/1993 | Gray | 156/651 |
| 5,280,221 | 1/1994 | Okamoto et al. | 315/169.1 |
| 5,308,439 | 5/1994 | Cronin et al. | 156/656 |
| 5,347,292 | 9/1994 | Ge et al. | 345/74 |
| 5,552,613 | 9/1996 | Nishibayashi et al. | 257/10 |

OTHER PUBLICATIONS

J. M. Fikiet and J. L. Plumb, "D–C Conduction and Electroluminescence in Dielectric–Embedded ZnS: Mn, Cu, Cl" Journal of the Electrochemical Society vol. 120, No. 9 (Sep. 1973) pp. 1238–1241.

S. Szuba and W. Polewska, "Electrical Properties of Amorphous and Crystalline Phases in Electroluminescent ZnS: Mn, Cu, Cl Films" Physica Status Solidi (a) vol. 71, (1982), pp. 65–71.

T. R. N. Kutty, A Controlled Copper–Coating Method for the Preparation of ZnS: Mn, DC Electroluminescent Powder Phosphors Materials Research Bulletin, vol. 26 (1991) pp. 399–406.

K. Derbyshire "Beyond AMLCDs: Field emissions displays?" Solid State Technology vol. 37, No. 11 (Nov. 1994) pp. 55–65.

*Primary Examiner*—Ashok Patel
*Assistant Examiner*—Matthew J. Gerike
*Attorney, Agent, or Firm*—Theodore R. Touw

[57] ABSTRACT

A microelectronic light-emitting device (10) is made with dual lateral thin-film emitters (35 and 40) substantially parallel to a substrate (20). Emitter electrodes (35 and 40) have a thickness of not more than several hundred angstroms. Each emitter has an emitting blade edge (110 or 115) having a small radius of curvature. Thus, opposed emitters for two opposite-sign carriers are provided, shaped to provide very high electric field intensity at their emitting tips. A region containing phosphor (50) extends between the two emitters and contacts them. When a suitable bias voltage is applied, electrons are injected into the phosphor from the blade edge of one emitter and holes are injected from the other emitter. The sum of diffusion lengths of the carriers (including secondary carriers) is equal to or greater than the shortest distance between the emitters. DC, AC, pulsed, or other voltage waveforms can be applied. Light emission is excited from the phosphor by carrier recombination. Devices may be combined in a matrix display array, and/or combined to form a super-pixel, and/or combined to form segments of a character display.

13 Claims, 5 Drawing Sheets

DUAL CARRIER DISPLAY DEVICE

This application is related to application Ser. No. 08/549,929 filed Oct. 30, 1995, now U.S. Pat. No. 5,669,802, and is a division of co-pending application Ser. No. 08/550,391 filed Oct. 30, 1995.

FIELD OF THE INVENTION

This invention relates in general to light-emitting devices and relates more particularly to microelectronic electroluminescent display devices having dual carrier emitters and to methods of fabricating such display devices.

BACKGROUND OF THE INVENTION

A number of light-emitting devices that employ phosphors have been used heretofore, including conventional fluorescent lamps, vacuum fluorescent displays (VFD's), electroluminescent lamps and displays, cathode ray tubes, and field-emission displays. The term electroluminescent devices has been used most frequently in reference to AC-excited or DC-excited devices employing electroluminescent phosphors. Cathode ray tubes, VFD's, and field-emission display devices generally employ cathodoluminescent phosphors.

NOTATIONS AND NOMENCLATURE

The term emitter is used throughout this specification to mean an electrode for emitting or injecting electric charge carriers of either sign, such as electrons and holes. Ohmic contact is used in its conventional meaning to denote an electrical contact that is non-rectifying. Phosphor is used in this specification to mean any material characterized by luminescence excited by charge carriers. Thus the term phosphor as used herein is intended to include those crystalline semiconductor materials exhibiting electroluminescence and commonly used in light-emitting diodes (LED's). In descriptions of some phosphors, a conventional notation is used wherein the chemical formula for a host or matrix compound is given first, followed by a colon and the formula for an activator (an impurity that activates the host crystal to luminesce), as in "ZnS:Mn," where zinc sulfide is the host and manganese is the activator. Some phosphors may also have co-activators such as halogens which affect the activation, denoted in the conventional scheme after a comma, as in "ZnS:Mn, Cl." The abbreviation "EL" is used herein to denote "electroluminescent" or "electroluminescence."

DESCRIPTION OF THE RELATED ART

An overview of the related art pertaining to display technology up to 1992 is provided by Joseph A. Castellano "Handbook of Display Technology" Academic Press, Inc. (San Diego, Calif. 1992). Experimental measurements of conduction and electroluminescence in ZnS:Mn, Cu, Cl were reported in an article by J. M. Fikiet and J. L. Plumb, Journal of the Electrochemical Society, vol. 120 no. 9 (September 1973) pp. 1238–1241. A method for preparation of ZnS:Mn phosphors was described in an article by T. R. N. Kutty, Materials Research Bulletin, vol. 26 (1991) pp. 399–406. Many publications and patents describe electroluminescent display devices and field-emission display devices. Thin-film electroluminescent devices are described in Barrow et al. (U.S. Pat. No. 4,751,427) and Sun (U.S. Pat. No. 4,897,319), for example. Various field-emission display devices are described, for example, in Borel et al. (U.S. Pat. Nos. 4,857,161 and 4,940,916), Spindt et al. (U.S. Pat. No. 4,857,799), Meyer (U.S. Pat. No. 4,908,539), Brodie et al. (U.S. Pat. Nos. 4,923,421 and 5,063,327), and Ge et al. (U.S. Pat. No. 5,347,292). Field emission devices having various lateral-emitter cathode constructions are described in Jones et al. (U.S. Pat. No. 5,144,191), Gray (U.S. Pat. Nos. 5,214,347 and 5,266,155), and J. E. Cronin et al. (U.S. Pat. Nos. 5,233,263 and 5,308,439), for example. An article by Katherine Derbyshire, "Beyond AMLCDs: Field Emission Displays?" Solid State Technology, Vol. 37 No. 11 (November 1994) pages 55–65, summarized fabrication methods and principles of operation of some competing designs for field emission devices and discussed some applications of field emission devices to flat-panel displays.

PROBLEMS SOLVED BY THE INVENTION

Conventional electroluminescent light sources commonly employ extra insulating layers or insulating binders or matrices which isolate the electroluminescent phosphor from the device electrodes. The present invention eliminates such insulating layers or matrices, thus reducing the cost and complexity of both the light-emitting device and the fabrication process used to make it. Conventional field-emission display devices have either a Spindt-type field emission cathode which emits electrons substantially perpendicular to a substrate across a gap to an anode, or else a lateral emitter which emits electrons substantially parallel to a substrate laterally across a gap to an anode that is spaced laterally from its emitting edge. In either type of field-emission display device, the gap is conventionally occupied by a vacuum or low-pressure gas and its width must be precisely controlled. The present invention eliminates the vacuum or low-pressure gas requirement and has no gap requiring precise control. Thus the present invention provides a very simple, easy-to-manufacture light-emitting device.

OBJECTS AND ADVANTAGES OF THE INVENTION

One object of the invention is a light-emitting device that is extremely simple in structure and operation. Another object is a light-emitting device that can be operated with low power input. Yet another object is a light-emitting device with low inter-electrode capacitance and thus improved high-frequency operation. Another object is a light-emitting device with relatively high phosphor area fraction. Another related object is a light-emitting device that can be fabricated very economically by a simple process specially adapted to its simple structure. Another related object is a fabrication process providing automatic alignment of the device elements. Another important object of the invention is a process using existing microelectronic fabrication techniques and apparatus for making integrated display device cell structures with economical yield and with precise control and reproducibility of device dimensions and alignments. Another object of the invention is a fabrication process which uses only a few masks, thus reducing fabrication time and cost. Another object is a light-emitting device that is readily adaptable to fabrication in very small sizes to produce microelectronic devices. A related object is a light-emitting device suitable for displays composed of arrays of microelectronic display devices. Another related object is a device readily adaptable for use in a matrix-controlled display. Another object is a display device also adaptable for use in segmented character displays. Yet another object is a light-emitting device adaptable for emitting various colors of light. An object related to that is a set of display devices emitting various colors of light, to be used together in a color display. Another object is a display device that may be fabricated from substantially transparent materials to provide a display adaptable for "heads up" displays and/or augmented reality displays. These and other objects and advantages will become apparent from reading this specification and its drawings and from practice of the invention.

SUMMARY OF THE INVENTION

In one aspect of the invention, a light-emitting device is made with dual lateral emitters substantially parallel to a substrate. The device has two thin-film emitter electrodes which have a thickness of not more than several hundred angstroms. Each of the two emitters has an emitting blade edge or tip having a small radius of curvature. Thus, opposed emitters for two opposite-sign carriers are provided in the same device and both are shaped to provide very high electric field intensity at their emitting tips. A region containing phosphor extends between the two emitters and contacts them. When a suitable bias voltage is applied, electrons are emitted from the blade edge or tip of one emitter into the phosphor and holes are injected from the other emitter. The sum of diffusion lengths of the two carrier types should be equal to or greater than the shortest distance between the two emitters. If secondary carriers are created within the phosphor, then the sum of diffusion lengths of the primary and secondary carriers should be equal to or greater than the distance between emitters. Either DC or AC bias voltage or pulsed or other voltage waveform can be applied. Light emission is excited from the phosphor by carrier recombination. A number of devices may be combined in an array to form a matrix display, and/or a number of devices may be combined to form a super-pixel. Alternatively, a number of devices may be combined to form segments of a character display.

In another aspect of the invention, a novel fabrication process using process steps similar to those of semiconductor integrated circuit fabrication is used to produce the novel light-emitting devices and/or arrays of light-emitting devices. Various embodiments of the fabrication process allow the use of conductive or insulating base or starting substrates. In a preferred fabrication process for the light-emitting device, the following steps are performed: an insulating substrate is provided; an ultra-thin conductive emitter film is deposited over the insulating substrate and patterned; an insulating layer is deposited over the emitter film; conductive contacts are made through the insulating layer to the emitter film; a trench opening is etched through the insulating layer and emitter film, thus forming and automatically aligning two emitting edges of two emitters; a phosphor is deposited into the trench opening; and means are provided for applying an electrical bias to the two emitter contacts, sufficient to cause injection of carriers from the emitting edges of the emitters into the phosphor.

DETAILED DESCRIPTION OF THE PREFERRED EMBODIMENTS

The invention may be further understood by considering the following preferred embodiments, which are intended to be exemplary of ways to make and use the invention, including the best mode contemplated by the inventor for carrying out the invention. In this description of the preferred embodiments, references are made to the drawings in which the same reference numbers are used throughout the various figures to designate the same or similar components. It should be noted that the drawings are not drawn to scale. In particular, the vertical scale of cross-section views is exaggerated for clarity, and thicknesses of various elements of the structures are not drawn to a uniform scale.

Device Structure

Figure 1:
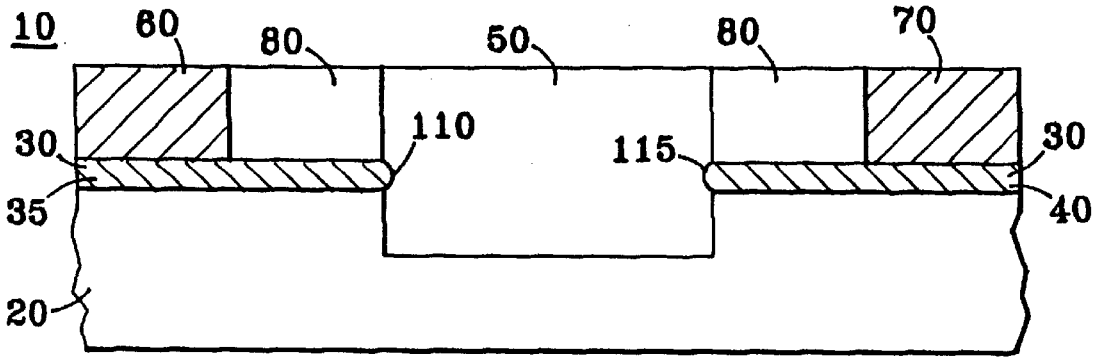
FIG. 1 shows a side elevation cross-sectional view of an embodiment of a light-emitting device made in accordance with the invention.
Figure 2:
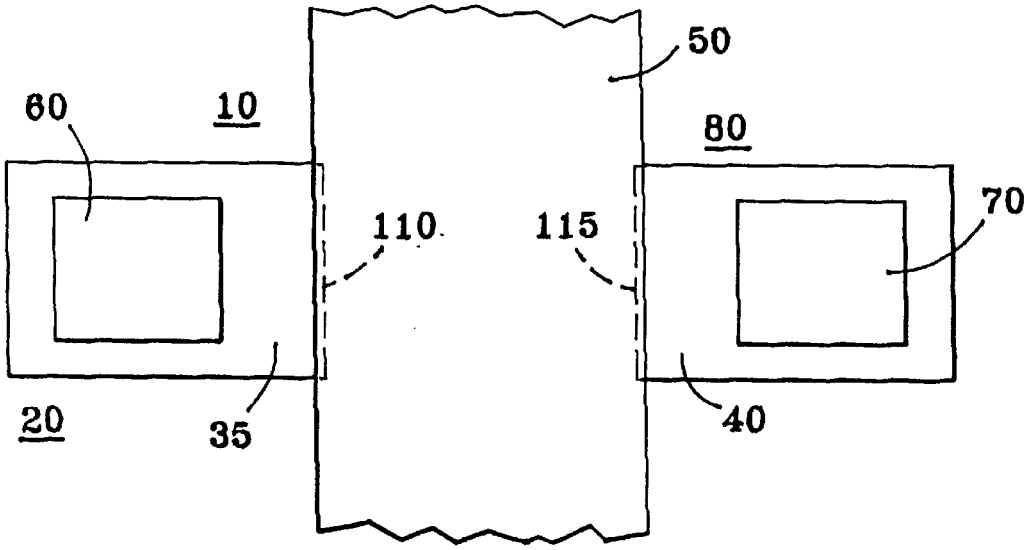
FIG. 2 shows a plan view of an embodiment of a light-emitting device made in accordance with the invention.

FIG. 1 shows a side elevation cross-sectional view, and FIG. 2 shows a plan view of an embodiment of a microelectronic light-emitting device made in accordance with the invention. The device, denoted generally by 10, is made on an insulating substrate 20. A ultra-thin layer 30 of conductive material provides an emitter layer parallel to the substrate and is patterned to form two emitters 35 and 40. It should be noted that emitters 35 and 40 may lie on the top surface of the substrate as shown in FIG. 1, or may be made by depositing conductive material for emitters 35 and 40 into recesses formed in insulating substrate 20 and by planarizing the resulting surface. In the preferred fabrication process described in detail below, a single emitter layer 30 is deposited and patterned, and only later is formed into two distinct lateral emitters 35 and 40. A region of phosphor 50 extends between the two lateral emitters 35 and 40 and makes contact with the emitters. Conductive contacts 60 and 70 make electrical contact (preferably ohmic contact) to emitters 35 and 40 respectively. A layer of insulator 80 preferably covers emitters 35 and 40, except at contacts 60 and 70.

If it is desired to fabricate the device over a base substrate 90 that is a conductor or semiconductor (not shown in FIG. 1), an insulating material such as silicon oxide may be deposited on the base substrate 90 to provide an insulating substrate 20. The thickness of the insulating material may be about 1,000 nanometers, for example. A planar silicon wafer is suitable for a starting or base substrate 90, but the base substrate may be a flat insulator material such as glass, $Al_2O_3$ (especially in the form of sapphire), silicon nitride, etc.

Each of emitters 35 and 40 has a blade edge or tip (110 and 115 respectively). Each blade edge or tip 110 and 115 has a very small radius of curvature, limited by half the thickness of the ultra-thin lateral-emitter layer. Preferred thicknesses of lateral-emitter film are less than about 30 nanometers, which limit the radius of curvature of lateral-emitter blade edges or tips 110 and 115 to be less than about 15 nanometers. Those skilled in the art will recognize that the radius of curvature is a significant factor in producing an electric field sufficient to cause carrier injection at a low applied bias voltage, and that the radius of curvature may be somewhat less than half of the film thickness.

Emitters 35 and 40 are preferably formed by depositing an ultra-thin film of a conductor, preferably 10–30 nanometers in thickness. Emitters 35 and 40 need not necessarily be the same materials and thickness, but for simplest fabrication are preferably the same material, deposited simultaneously in one operation. Preferred emitter materials are chromium, indium, tantalum, titanium, tin oxide, indium tin oxide (ITO), molybdenum, tungsten, and mixtures, solid solutions, and alloys thereof. But many other conductors may be used, such as conductive carbon, aluminum, copper, copper-doped aluminum, gold, silver, platinum, palladium, rhodium, polycrystalline silicon, and mixtures, solid solutions, and alloys thereof. For some applications, transparent thin film conductors such as tin oxide or indium tin oxide (ITO) are especially useful. For such applications, the entire device may be made of substantially transparent materials. Such a construction can be employed, for example, in a display used to augment a visual field viewed through the device, with imagery, graphics, or text superimposed on the field of view.

Insulating layer 80 should preferably be a dielectric with low reflectivity for best contrast. It may have an anti-reflective coating to enhance contrast. Its electric permittivity is not critical. Suitable insulating materials, for example, are aluminum oxide ($Al_2O_3$), silicon nitride ($Si_3N_4$), and silicon dioxide ($SiO_2$). Insulating layer 80 may be omitted entirely for some applications of the device. Also, it is not essential for operation of the device that the insulating layer 80 over emitter 35 be of the same material or thickness as the insulating material over emitter 40. For the simplest device structure and fabrication process, however, those insulating materials may be made the same and may be deposited simultaneously in one operation. Yet another possible structure has phosphor 50 covering the emitters; that is the phosphor 50 and insulator 80 may be composed of the same material. In such a device structure, spacing of conductive contacts 60 and 70 from phosphor 50 is not necessary.

Preferred materials for phosphor 50 are electroluminescent (EL) phosphors selected to have electrical resistivity preferably greater than about $10^5$ ohm-cm. at the use temperature, and electric permittivity preferably less than about 20. The phosphor selected should have carrier diffusion lengths such that the sum of electron and hole diffusion lengths is greater than or equal to the width of phosphor region 50 in the device (i.e. the shortest distance between emitting edges 110 and 115). Or, expressed another way, the average of the two diffusion lengths should be greater than one-half the shortest spacing between emitting edges 110 and 115 of emitters 35 and 40. (If secondary carriers are generated within phosphor 50 by energetic primary carriers, then the sum of primary and secondary carrier diffusion lengths may meet this criterion.) Phosphors conventionally used for AC or DC EL display devices are generally suitable. Several suitable phosphors are listed in a review chapter by Takashi Hase et al., "Phosphor Materials for Cathode Ray Tubes" in "Advances in Electronics and Electron Physics" Vol. 79 (Academic Press, San Diego, Calif. 1990), pages 271–373, which reference also uses the conventional phosphor notation used here. Specific examples of suitable phosphors are zinc oxide; zinc sulfide activated with manganese, copper, silver, a rare-earth element such as europium, (with or without co-activators such as chlorine or other halogen, or aluminum); yttrium or lanthanum oxides, double oxides, or oxysulfides, with or without rare-earth activators; and strontium sulfide activated with cerium fluoride. Organic phosphors may also be used.

The microelectronic light-emitting device of this invention is especially well suited for integration into an array, such as a two-dimensional matrix array of microelectronic display devices, each device being addressable by selective application of bias voltages to excite light emission. In such an array, the devices may be arranged in pairs such that a first or second emitter electrode of one of the devices is in electrical contact with a first or second emitter electrode of the other device of the pair, respectively. A number of adjacent devices of a display may be combined with common driving connections to form a super-pixel. The devices may also be combined in sets forming a segment display, such as the conventional seven-segment type of character display, or character displays with more or fewer segments. For applications such as "heads up" displays and/or augmented reality displays, for example, the array of devices may be fabricated entirely from substantially transparent materials.

Figure 5:
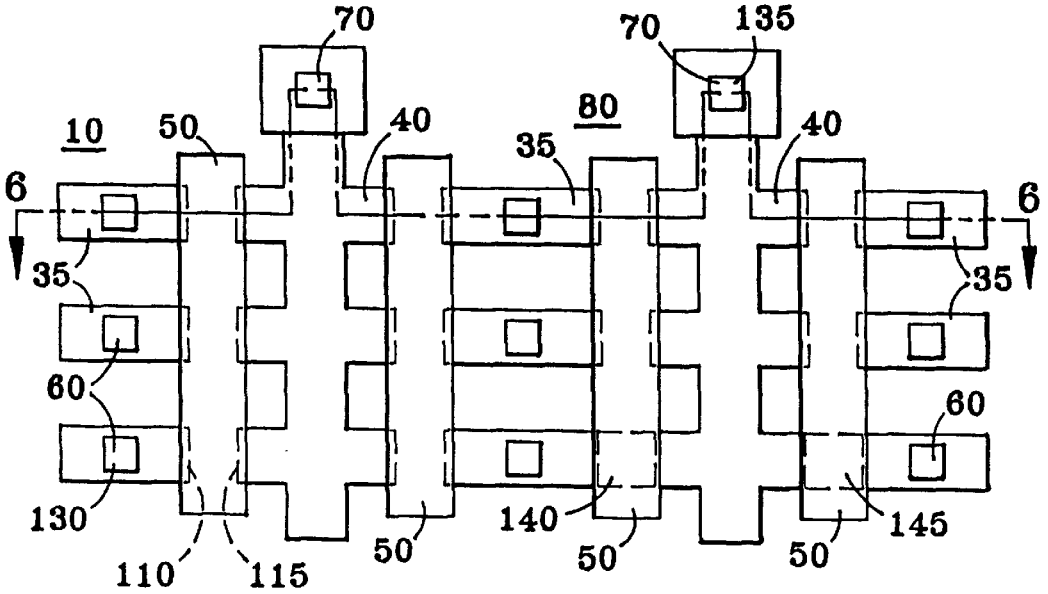
FIG. 5 shows a plan view of a portion of an array of light-emitting devices made in accordance with the invention.
Figure 6:
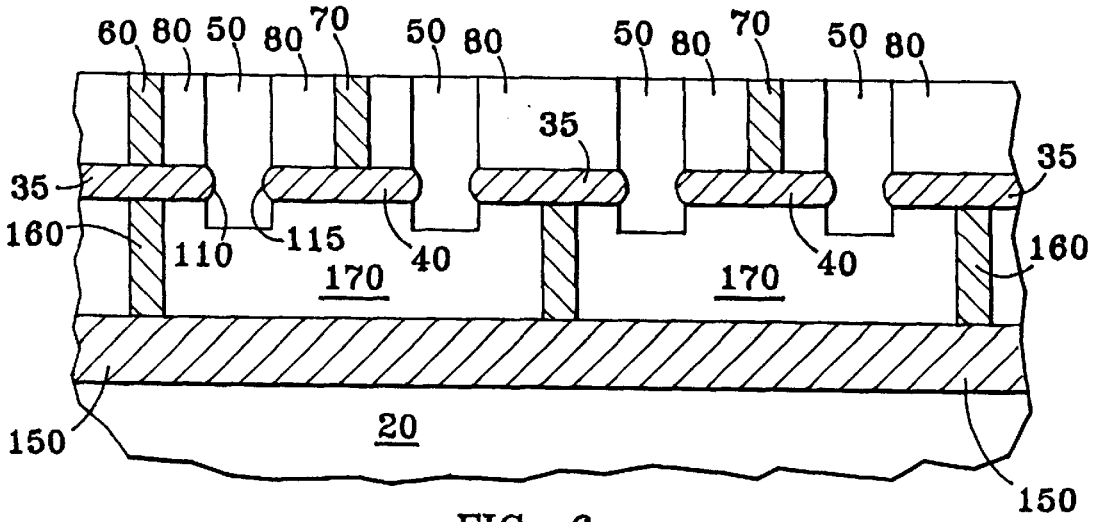
FIG. 6 shows a side elevation cross-sectional view of the array of FIG. 5.

FIG. 5 shows a plan view of a portion of an array of light-emitting devices made in accordance with the invention, and FIG. 6 shows a side elevation cross-sectional view of the array of FIG. 5. It will be recognized by those skilled in the art that the arrangement depicted in FIGS. 5 and 6 may be extended along both vertical and horizontal axes of FIG. 5 to form a larger array having many more devices addressable in a matrix. The arrangement shown in FIG. 6 has a set of buried conductors 150 extending under emitters 35 and connected electrically to emitters 35 by conductive contacts 160 similar to conductive contacts 60 and 70 described hereinabove. Buried conductors 150 extend in the horizontal direction of FIG. 5, as shown in FIG. 6. Thus the emitters 35 are interconnected horizontally. Emitters 40 are interconnected along the vertical direction of FIG. 5. When a suitable bias voltage is applied to a pair of emitters 35 and 40, two sites along two adjacent stripes of phosphor 50 are excited to emit light. In FIG. 5, application of a negative voltage at 130 and a positive voltage at 135 causes light emission from phosphor 50 at both sites designated by reference numerals 140 and 145. The pair of emitting sites 140 and 145 may be considered a single pixel of the array display. For this and other reasons, it is preferable to make phosphor stripes 50 as close as possible together. If an array with uniform pixel pitch is desired, the dimensions of the various elements are adjusted accordingly, taking into account the fact that each pixel consists of two emitting sites for the array arrangement of FIGS. 5 and 6. A display array as in FIGS. 5 and 6 may be made using as few as five lithography mask levels. It will be apparent to those skilled in the art that array configurations other than the arrangement of FIGS. 5 and 6 are possible.

Fabrication Process

Figure 3:
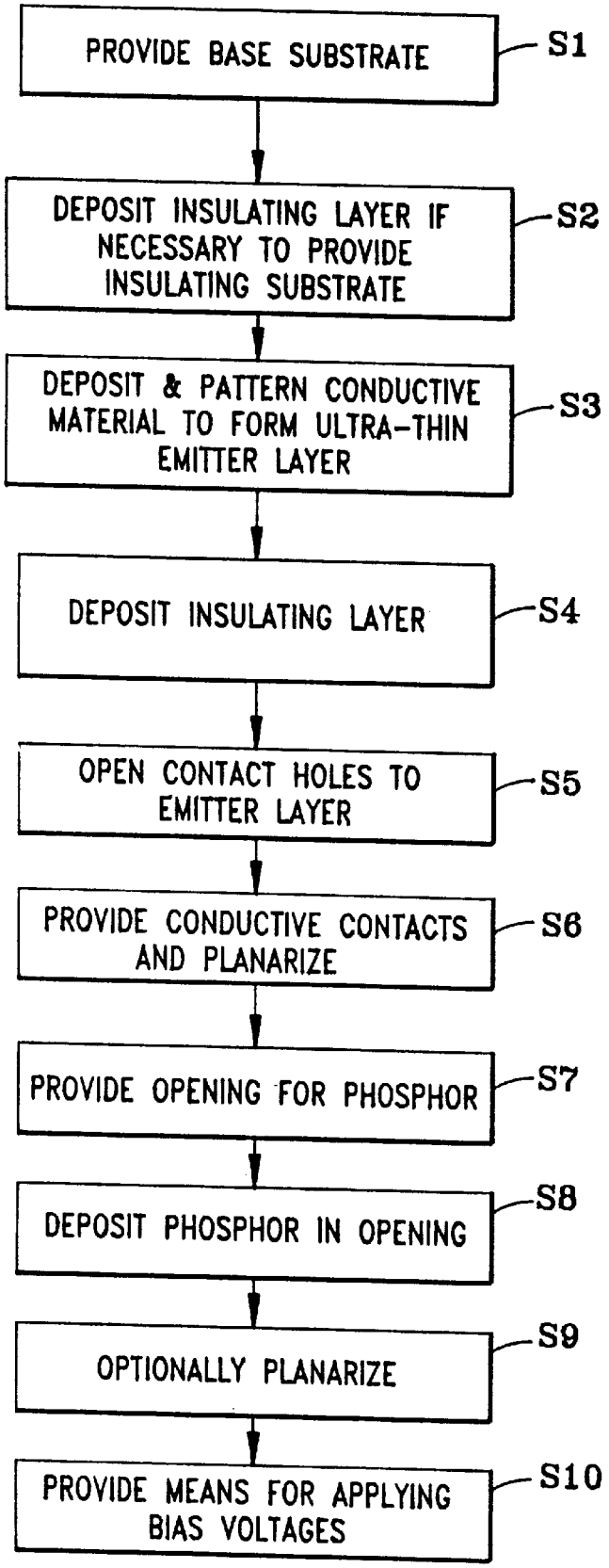
FIG. 3 shows a flow diagram of an embodiment of a fabrication process performed in accordance with the invention.

FIG. 3 shows a flow diagram of an embodiment of a fabrication process performed in accordance with the invention, with step numbers indicated by references S1, etc. FIGS. 4*a*–4*j* together show a sequence of side elevation cross-sectional views corresponding to results of the process steps of FIG. 3. Each sectional view of FIGS. 4*a*–4*j* shows the result of the process step indicated next to the sectional view. The identities and functions of individual elements in the sectional views of FIGS 4*a*–4*j* will be apparent by comparison with FIGS. 1 and 2. As in the case of FIGS. 1 and 2, the drawings are not drawn to scale. In particular, the vertical scale of cross-section views of FIGS. 4*a*–4*j* is exaggerated for clarity, and thicknesses of various elements of the structures are not drawn to a uniform scale.

As shown in FIGS. 3, 4*a*–4*j*, the preferred fabrication process begins (illustrated at FIG. 4*a*) with step S1 of providing a base substrate 90. If base substrate 90 is composed of an insulating material, step S2 is not necessary. If base substrate 90 is a conductor or semiconductor, step S2 is performed to deposit an insulating material on the base substrate to provide an insulating substrate 20. For example, base substrate 90 may be a single-crystal silicon wafer, and insulating material composed of silicon oxide may be grown or deposited on the silicon wafer to provide a silicon oxide insulating substrate 20. The thickness of silicon oxide may be about 1,000 nanometers, for example.

In step S3, an ultra-thin conductive film is deposited on insulating substrate 20 and patterned to provide an emitter film 30. Suitable compositions and thickness for emitter film 30 are described hereinabove under the heading Device Structure. Emitter film 30 may be composed of about 15 nanometers of chromium, for example. The pattern of emitter film 30 may be recessed into the surface of insulating substrate 20 if desired. Thus step S3 may be performed by patterning and etching recesses about 15 nanometers deep into the top surface of insulating substrate 20, filling the recesses with conductive material and planarizing the surface to leave conductive material only in the recesses.

In step S4, an insulating layer 80 may be deposited over conductive emitter film 30. This step may be performed by depositing about 200 nanometers of silicon oxide by chemical vapor deposition, or by depositing about 200 nanometers of spun-on glass, for example. Insulating layer 80 may be a composite layer composed of successive layers of different materials. For some applications, polyimide may be used for insulating layer 80. In step S5, contact openings are formed through insulating layer 80, aligned to the patterned emitter film 30. This completes the portion of the process that is illustrated in FIGS. 4*a*–4*e*. In step S6 (illustrated by FIG. 4*f*), the contact holes are filled with conductive material such as aluminum to make electrical contact with emitter film 30, and may be planarized. Chemical-mechanical polishing may be used to planarize the surface. The conductive contacts formed in step S6 are to be used to apply electrical bias to the light-emitting device when it is used. In step S7, an opening for phosphor is formed through insulating layer 80 and at least through emitter film 30. This opening may be formed by directionally etching, e.g. by ion milling or by reactive-ion-etching, to a depth of about 300 nanometers for the examples of film thicknesses described above. The opening may extend beyond emitter layer 30 partly into the surface of insulating substrate 20, as it does in this example. Forming this trench-like opening through emitter film 30 divides emitter film into two opposed lateral emitters 35 and 40 and automatically forms emitting blade edges 110 and 115 on emitter 35 and 40 respectively.

Figure 4A:
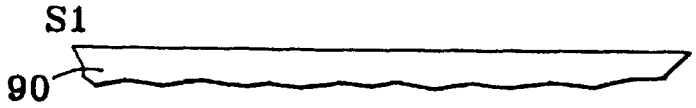
FIGS. 4*a*–4*j* show a series of side elevation cross-sectional views corresponding to results of the process steps of FIG. 3.
Figure 4B:
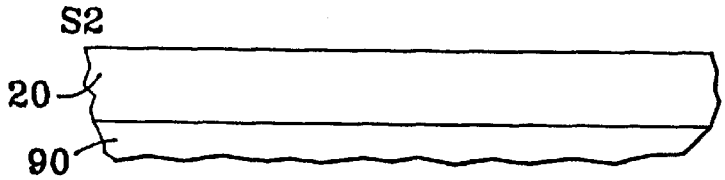
Figure 4C:
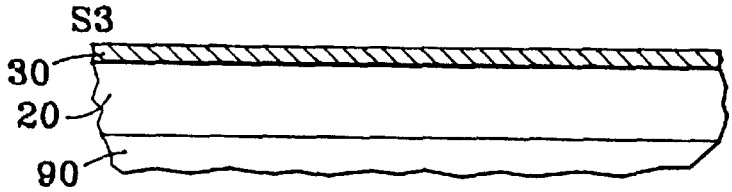
Figure 4D:
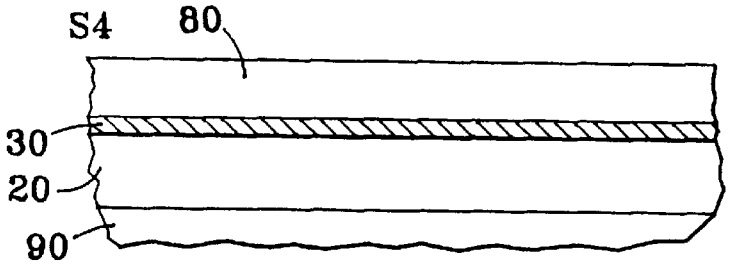
Figure 4E:
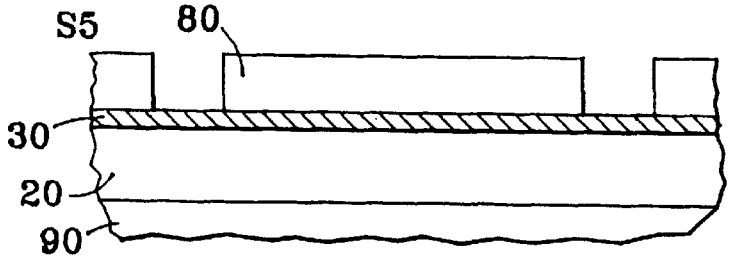
Figure 4F:
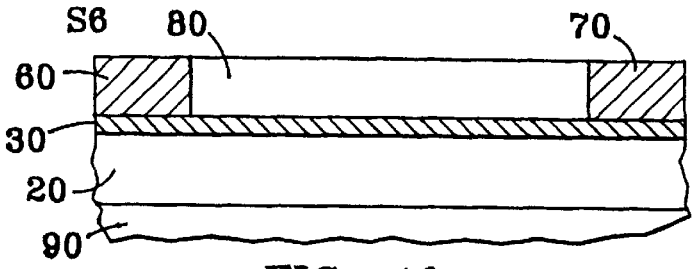
Figure 4G:
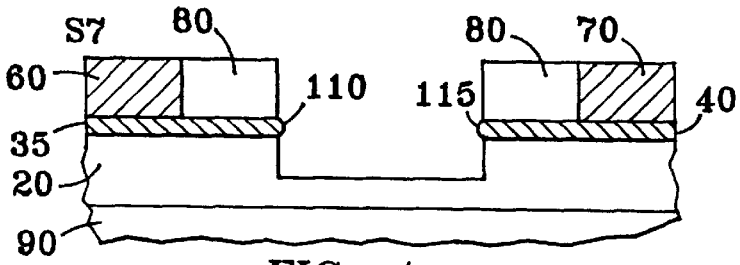
Figure 4H:
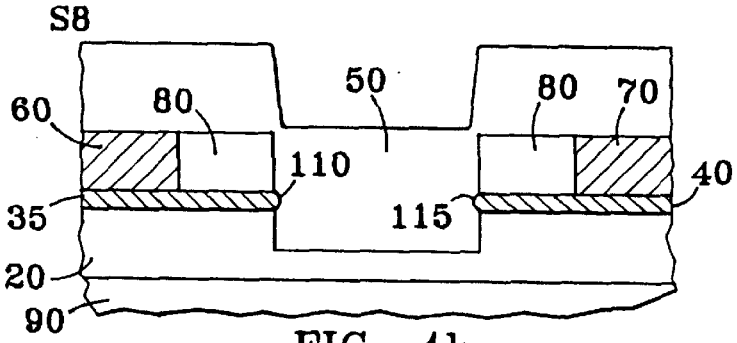
Figure 4I:
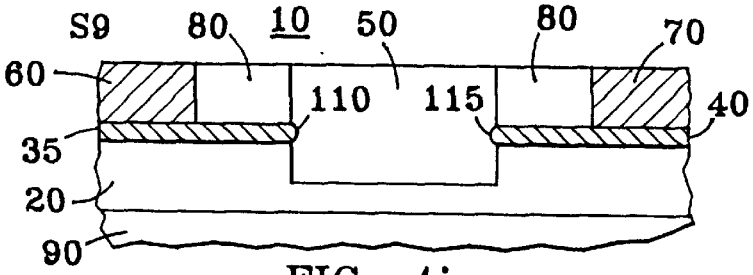
Figure 4J:
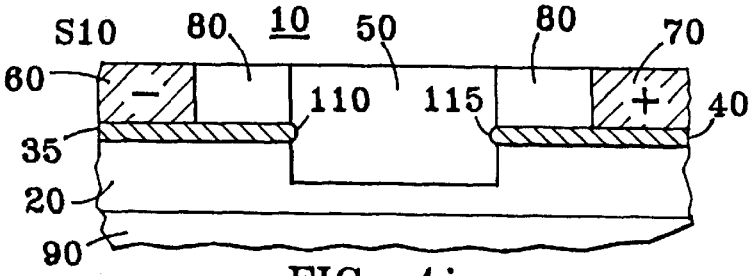

In step S8, phosphor material 50 is deposited into the opening, at least until the phosphor contacts emitting edges 110 and 115 of lateral emitters 35 and 40. If the phosphor region 50 is filled as illustrated in FIG. 4*h*, the device may be planarized in step S9, for example by chemical-mechanical polishing. Step S10 represents the step of providing means of applying bias voltages, represented in the illustration of FIG. 4*j* by plus (+) and minus (−) signs on conductive contacts 60 and 70. It will be apparent that any conductive means of connecting DC or AC bias voltages or pulsed or other voltage waveform from batteries, generators, mains-operated power supplies, etc. may be employed, depending on the applications of the light-emitting device 10. For applications using multiple light-emitting devices, the means for applying bias voltages can include means for selectively applying the biases to individual light-emitting devices, such as matrix display pixels or character display segments, or to groups of light-emitting devices, such as the elements of a super-pixel. The bias voltage application means can of course include any type of switch, relay, transistor, integrated circuit, etc., especially when the voltage application is made selectively.

Industrial Applicability

The light-emitting device of this invention has many uses such as a light source for nearly any purpose and such as a component of displays including flat panel displays. The individual devices may be microelectronic devices, and may be combined in arrays of integrated devices fabricated together on the same substrate. Microelectronic devices may have sub-micrometer dimensions or may be somewhat larger. The devices may be combined in a matrix display used for virtual reality applications or for a computer output display. Suitably shaped devices may be combined in a segmented character display such as a seven-segment display for alphanumeric characters. A number of small display devices may be spatially and electrically grouped together to form a larger display element or "super pixel" in a matrix array. Such grouping may be extended to large-screen displays and to very large displays such as billboards. Displays made entirely of substantially transparent materials, as described hereinabove, may be used for "heads up" displays and augmented reality applications.

From the foregoing description, one skilled in the art can easily ascertain the essential characteristics of this invention, and without departing from the spirit and scope thereof, can make various changes and modifications of the invention to adapt it to various usages and conditions. Other embodiments of the invention will be apparent to those skilled in the art from a consideration of this specification or from practice of the invention disclosed herein. It is intended that the specification and examples be considered as exemplary only, with the true scope and spirit of the invention being defined by the following claims.

Having described my invention, I claim:

1. A microelectronic device for producing light, comprising:

(a) a substrate having an insulating surface;

(b) conductive first and second electrodes, said first and second electrodes being disposed substantially parallel to said insulating surface of said substrate, said first and second electrodes being spaced apart one from the other, said first electrode having a first edge, and said second electrode having a second edge;

(c) a quantity of phosphor disposed between said first and second electrodes and in contact with said first and second edges of said electrodes; and (d) means for applying bias voltages to said first and second electrodes, said bias voltages being sufficient to inject first carriers from said first electrode into said phosphor and to inject second carriers from said second electrode into said phosphor to induce light emission therefrom.

2. A microelectronic device for producing light as recited in claim 1, wherein said phosphor is characterized by resistivity greater than about $10^5$ ohm-centimeters and by electric permittivity less than about 20.

3. A microelectronic device for producing light as recited in claim 1, wherein said first carriers are electrons and said second carriers are holes.

4. A microelectronic device for producing light as recited in claim 1, wherein said phosphor is characterized by carrier diffusion lengths such that the sum of carrier diffusion lengths for electrons and holes is equal to at least the distance between said first and second edges of said electrodes.

5. A microelectronic device for producing light as recited in claim 1, wherein said first electrode comprises a thin film of about several tens of nanometers thickness.

6. A microelectronic device for producing light as recited in claim 1, wherein said second electrode comprises a thin film of about several tens of nanometers thickness.

7. A microelectronic device for producing light as recited in claim 1, wherein each of said first and second edges has a radius of curvature, and each of said radii of curvature is less than about 30 nanometers.

8. A display comprising a plurality of microelectronic devices as recited in claim 1, wherein each of said plurality of devices is addressable by selectively applying said bias voltages to selectively induce light emission from each of said devices.

9. A display as recited in claim 8, wherein said devices are disposed in an array.

10. A display as recited in claim 9 wherein said array comprises a plurality of pairs of said devices, each of said pairs comprising a first device and a second device, and wherein said first electrode of said first device is in electrical contact with said first electrode of said second device.

11. A display as recited in claim 9 wherein said array comprises a plurality of pairs of said devices, each of said pairs comprising a first device and a second device, and wherein said second electrode of said first device is in electrical contact with said second electrode of said second device.

12. A display as recited in claim 9, wherein said array is a two-dimensional array.

13. A display as recited in claim 9, wherein said array is composed of substantially transparent materials.

* * * * *